US009413069B2

(12) United States Patent
Chieh et al.

(10) Patent No.: US 9,413,069 B2
(45) Date of Patent: Aug. 9, 2016

(54) COMPACT, MULTI-PORT, WI-FI DUAL BAND MIMO ANTENNA SYSTEM

(71) Applicants: Yang Wen Chieh, Zhongli (TW); Ronan Quinlan, Wexford (IE)

(72) Inventors: Yang Wen Chieh, Zhongli (TW); Ronan Quinlan, Wexford (IE)

(73) Assignee: TAOGLAS GROUP HOLDINGS LIMITED, Wexford (IE)

( * ) Notice: Subject to any disclaimer, the term of this patent is extended or adjusted under 35 U.S.C. 154(b) by 163 days.

(21) Appl. No.: 14/460,329

(22) Filed: Aug. 14, 2014

(65) Prior Publication Data

US 2015/0035719 A1 Feb. 5, 2015

Related U.S. Application Data

(63) Continuation-in-part of application No. 14/189,984, filed on Feb. 25, 2014, now abandoned.

(60) Provisional application No. 61/768,541, filed on Feb. 25, 2013.

(51) Int. Cl.

| | |
|---|---|
| ***H01Q 1/48*** | (2006.01) |
| ***H01Q 5/371*** | (2015.01) |
| ***H01Q 1/38*** | (2006.01) |
| ***H01Q 9/42*** | (2006.01) |
| ***H01Q 21/28*** | (2006.01) |

(52) U.S. Cl.
CPC ..... *H01Q 5/371* (2015.01); *H01Q 1/38* (2013.01); *H01Q 9/42* (2013.01); *H01Q 21/28* (2013.01)

(58) Field of Classification Search
CPC ..... H01Q 1/48; H01Q 21/30
USPC ..... 343/848, 702, 749, 895
See application file for complete search history.

(56) References Cited

U.S. PATENT DOCUMENTS

| | | | | |
|---|---|---|---|---|
| 5,936,587 | A * | 8/1999 | Gudilev | H01Q 1/36 343/702 |
| 6,842,148 | B2 * | 1/2005 | Hendler | H01Q 1/38 343/702 |
| 7,408,512 | B1 * | 8/2008 | Rodenbeck | H01Q 1/2208 343/700 MS |
| 7,411,554 | B2 * | 8/2008 | Jung | H01Q 1/243 343/700 MS |
| 7,714,795 | B2 * | 5/2010 | Wen | H01Q 5/357 343/700 MS |
| 8,952,850 | B2 * | 2/2015 | Park | H01Q 1/521 343/700 MS |
| 2012/0127056 | A1 * | 5/2012 | Park | H01Q 1/521 343/853 |

* cited by examiner

*Primary Examiner* — Huedung Mancuso
(74) *Attorney, Agent, or Firm* — Coastal Patent Law Group, P.C.

(57) ABSTRACT

In various embodiments, a compact, multi-port, multi-band, Wi-Fi antenna system is configured for high-isolation and improved performance. The antenna includes four monopole type antennas each having at least two resonances including 2.4 GHz and 5 GHz for use in Wi-Fi applications.

9 Claims, 3 Drawing Sheets

COMPACT, MULTI-PORT, WI-FI DUAL BAND MIMO ANTENNA SYSTEM

CROSS-REFERENCE TO RELATED APPLICATIONS

This application is a continuation in part (CIP) of U.S. Ser. No. 14/189,984, filed Feb. 25, 2014;

which claims benefit of priority with U.S. Provisional Ser. No. 61/768,541, filed Feb. 25, 2013;

the contents of each of which are hereby incorporated by reference.

BACKGROUND OF THE INVENTION

1. Field of the Invention

This application relates to wireless communications; and more particularly to multi-port, multi-band Wi-Fi antenna systems having high isolation for providing high speed data communication in Wi-Fi applications.

2. Description of the Related Art

Wi-Fi technology has become ubiquitous in modern society. Multi-input multi-output (MIMO) technology has been shown to improve transfer speed and signal reliability to achieve better quality of services in various communication platforms. The latest generations of Wi-Fi access points demand high efficiency the associated antenna structures and high isolation.

Faced with these demands and requirements, antenna designers are being required to provide multi-port antenna designs with high efficiency and good isolation to help achieve the requirements of modern communication devices. The design challenge is to provide and antenna system in a compact size, with equal performance of all four or more antenna elements, the system being low-cost, and still achieving overall system performance requirements. New compact solutions must be envisaged due to the limited area and volume that is available for antennas in these smaller modern devices.

SUMMARY OF THE INVENTION

In various embodiments, a compact, multi-port, multi-band, Wi-Fi antenna system is configured for high-isolation and improved performance. The antenna includes four monopole type antennas each having at least two resonances including 2.4 GHz and 5 GHz for use in Wi-Fi applications.

BRIEF DESCRIPTIONS OF THE DRAWINGS

DETAILED DESCRIPTION OF THE PREFERRED EMBODIMENT

A compact, multi-port, multi-band, Wi-Fi antenna system is configured for high-isolation and improved performance in the dual Wi-Fi band including 2.4 GHz and 5 GHz resonances. The antenna system is capable of reduced size and high isolation for providing faster data transfer speeds and other desirable features. for example, increasing transfer speeds relating to large or high quality media transactions.

Current standards such as IEEE 802.11n are published for providing increased data transfer speeds and are adapted for use with Multi-Input Multi-Output (MIMO) antenna architectures. The antenna system described herein is designed to support multiple ports with improved self-isolation.

In one embodiment, the antenna system comprises four antenna radiating elements, each of the antenna radiating elements comprises a monopole type radiating element. Each antenna element is designed as small as possible resulting in enhanced isolation performance at each and every port. The isolation value can achieve −12 dB. Antenna ground planes have been separated, further resulting in decreased self-interference between multiple ports.

The antenna system can be printed, plated, etched, or otherwise fabricated on a substrate. The substrate may include a flexible substrate for providing a flexible antenna product; however, the substrate may alternatively include a rigid substrate. Where a flexible substrate is used, one or more copper pads can be positioned on the flexible PCB for improving antenna main body strength for reducing the likelihood of tearing or breaking.

Each monopole type antenna radiating element is configured to separate to two bands if needed, including coverage of Wi-Fi lower resonance (2.4 GHz) and Wi-Fi higher band resonance (5 GHz), depending on how the MIMO system elects to process the signal stream, as single band input/output or dual-band input/output.

Figure 1A:
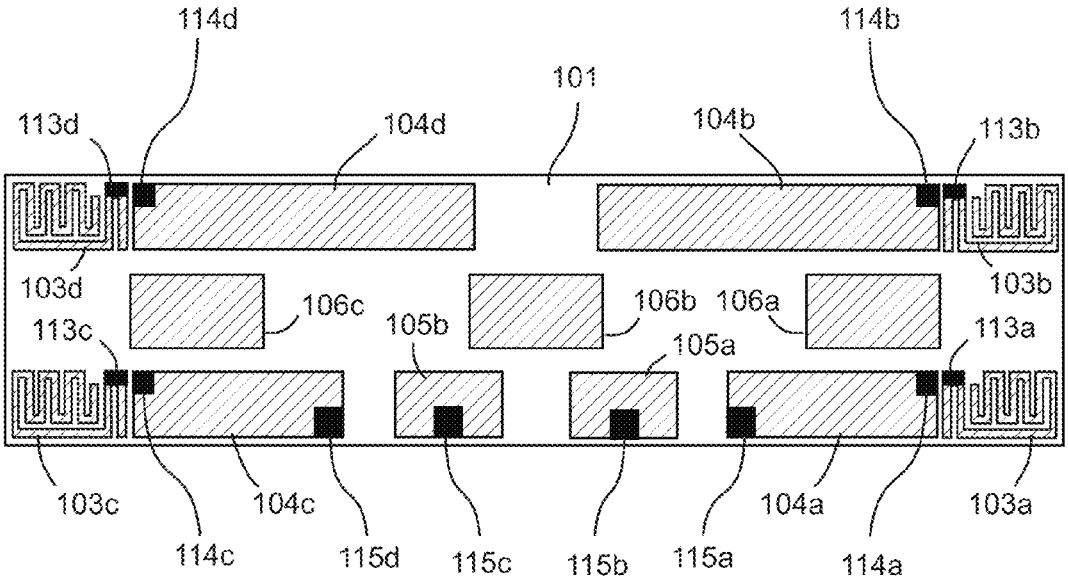
FIG. 1A shows a top view of the antenna system in accordance with an embodiment.

Now turning to the drawings, FIG. 1A shows a top view of the antenna system in accordance with an embodiment.

The antenna comprises a substrate 101 having a planar rectangular shape; for example, the substrate can include dimensions of 80 mm (length)×20 mm (width)×0.1 mm (thickness). On the substrate is printed or otherwise disposed a conductive layer 102; the conductive layer may include copper or other metal. In particular, a first antenna radiating element 103*a* is positioned at a first corner of the substrate, a second antenna radiating element 103*b* is positioned at a second corner of the substrate, a third antenna radiating element 103*c* is positioned at a third corner of the substrate, and a fourth antenna radiating element 103*d* is shown being positioned at a fourth corner of the substrate. Each of the first through fourth antenna elements 103(*a-d*) comprises a first radiating portion configured for high band resonance, and a second radiating portion configured for low band resonance. An antenna feed pad 113(*a-d*) is coupled to each of the respective antenna radiating elements; the antenna feed pad is disposed on the respective antenna radiating element between the first radiating portion and the second radiating portion thereof. Four ground conductors 104(*a-d*) are shown each having a length and a width aligned with that of the substrate; wherein each respective ground conductor is positioned adjacent to a respective antenna radiating element with the ground conductor being positioned to a side of the first radiating portion thereof. Thus, the first ground conductor 104*a* is positioned parallel with the second ground conductor 104*b;* and the third ground conductor 104*c* is positioned parallel with the fourth ground conductor 104*d*. Each of the respective ground conductors 104(*a-d*) comprises a ground solder pad 114(*a-d*). The feed pad 113*a* and ground pad 114*a* of the first antenna radiating element 113*a* and the first ground conductor 104*a,* respectively, are adapted for attachment with a coaxial cable. In this regard, each antennas, ground conductors, feed and ground pads are configured to be attached with one of four coaxial cables associated with the four antennas.

For added rigidity, rows of one or more structural conductors 105(*a-b*); 106(*a-c*) are provided. In this regard the flexible substrate can be bent about a horizontal bending line between the rows of conductors. Structural solder pads 115(*a-d*) are disposed on the first and third ground conductors 104*a;* 104*c,* respectively, and two of the structural conductors 105(*a-b*); each of these structural solder pads is configured to receive an amount of solder for securing the cable to prevent breakage.

The illustrated antenna system is symmetrical about a longitudinal center of the substrate; with the first and second antenna radiating elements being configured to oppose the third and fourth antenna radiating elements.

Figure 1B:
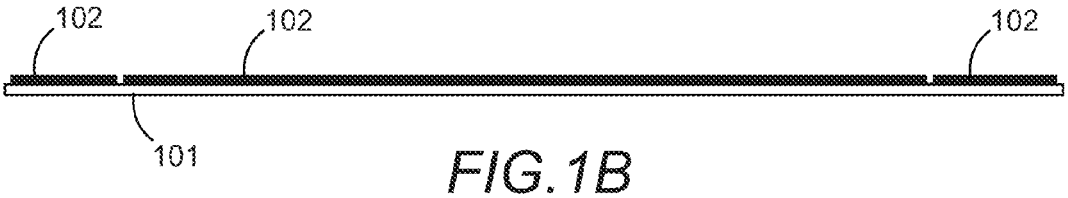
FIG. 1B shows a side view of the antenna system of FIG. 1.

FIG. 1B shows a side view of the antenna system of FIG. 1. The antenna system is shown including a substrate 101 and a conductive layer 102.

Figure 2:
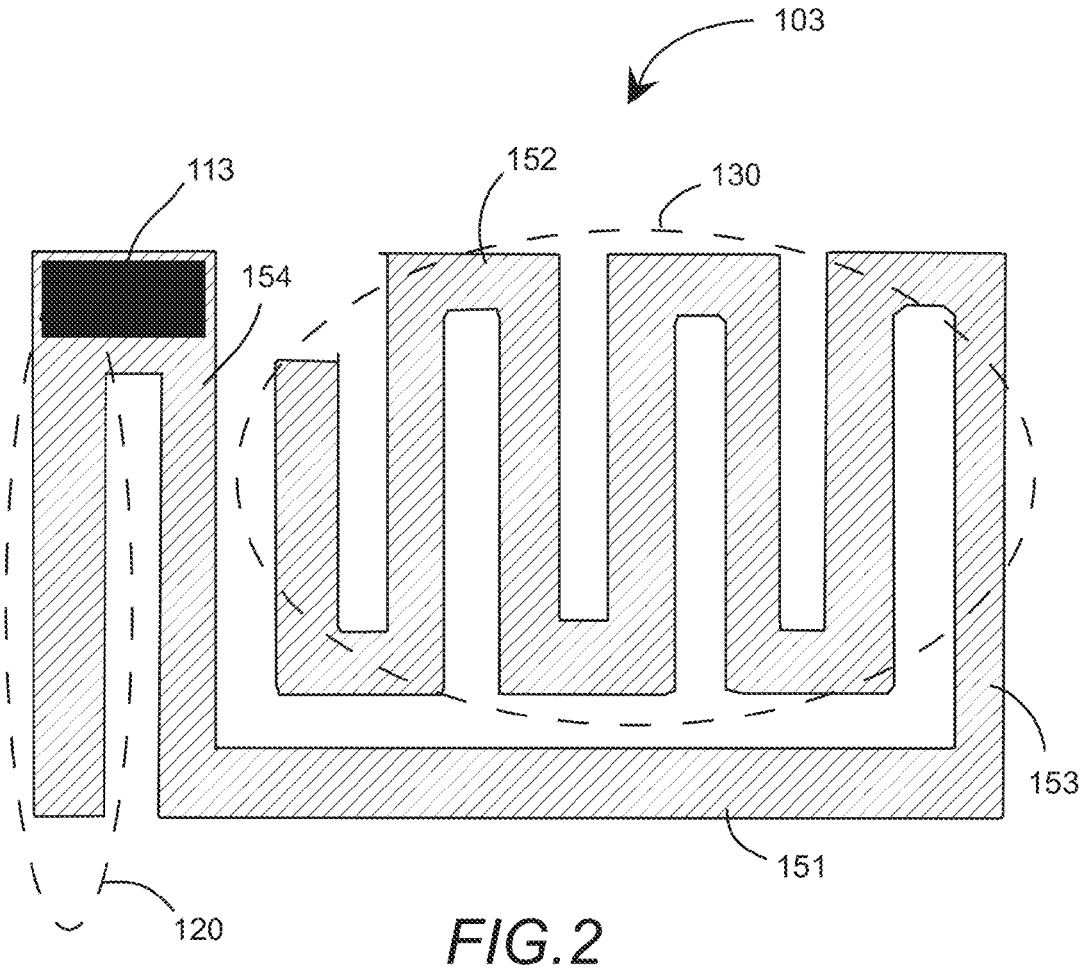
FIG. 2 shows a monopole type antenna radiating element associated with the antenna system of FIGS. 1(A-B).

FIG. 2 shows a monopole type antenna radiating element 103 associated with the antenna system of FIGS. 1(A-B). The monopole type radiating element comprises a feed pad 113, a first radiating portion 120 extending from the feed pad to a distal end, the first radiating portion 120 is configured for a high band resonance. A second radiating portion 130 extends from the feed pad 113 and comprises a meander line section 152 disposed parallel with a longitudinal conductor 151, the meander line section 152 is coupled to the longitudinal conductor 151 by a first coupling conductor 153 extending therebetween, and the longitudinal conductor is coupled to the feed pad 113 by a second coupling conductor 154 extending therebetween.

Figure 3:
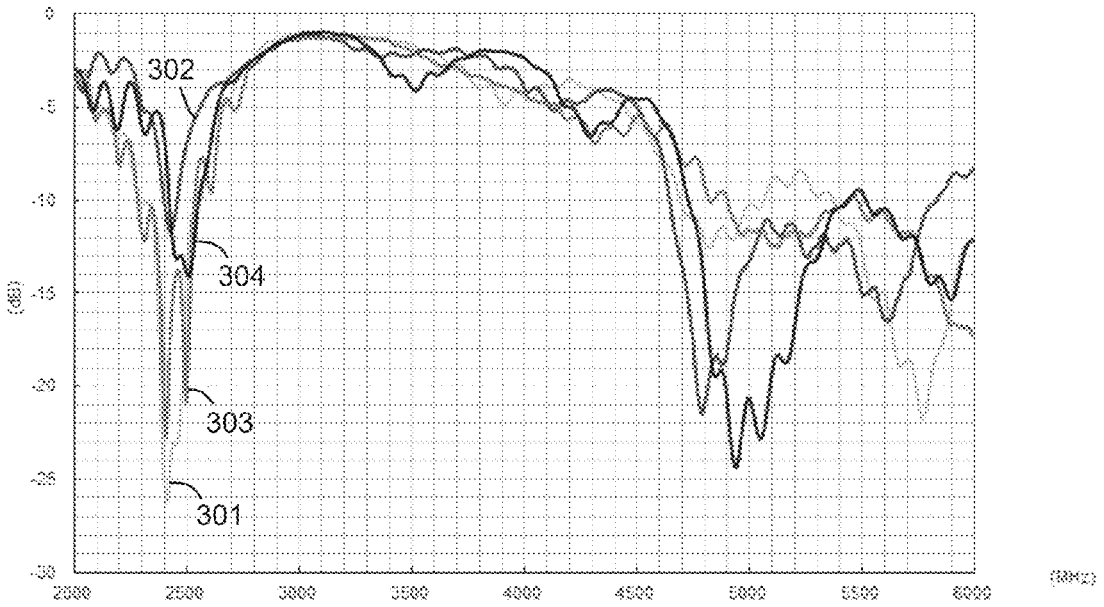
FIG. 3 shows a plot of return loss as a function of frequency for the antenna system of FIGS. 1A-2.

FIG. 3 shows a plot of return loss as a function of frequency for the antenna system of FIGS. 1A-2. The plot comprises four respective patterns 301; 302; 303; and 304; wherein the first pattern 301 is associated with the first antenna radiating element 103*a* and a first port associated therewith; the second pattern 302 is associated with the second antenna radiating element 103*b* and a second port associated therewith; the third pattern 303 is associated with the third antenna radiating element 103*c* and a third port associated therewith; and the fourth pattern 304 is associated with the fourth antenna radiating element 103*d* and a fourth port associated therewith.

What is claimed is:

1. And antenna system, comprising:

a substrate having a rectangular shape with a length, a width, and a thickness associated therewith;

a first antenna radiating element positioned at a first corner of the substrate, the first antenna radiating element having a first feed pad disposed thereon;

a first ground conductor positioned adjacent to the first antenna radiating element, the first ground conductor comprising a first ground pad thereon, the first ground pad being adjacent to the first feed pad of the first antenna radiating element;

a second antenna radiating element positioned at a second corner of the substrate, the second antenna radiating element having a second feed pad disposed thereon;

a second ground conductor positioned adjacent to the second antenna radiating element, the second ground conductor comprising a second ground pad thereon, the second ground pad being adjacent to the second feed pad of the second antenna radiating element;

a third antenna radiating element positioned at a third corner of the substrate, the third antenna radiating element having a third feed pad disposed thereon;

a third ground conductor positioned adjacent to the third antenna radiating element, the third ground conductor comprising a third ground pad thereon, the third ground pad being adjacent to the third feed pad of the third antenna radiating element;

a fourth antenna radiating element positioned at a fourth corner of the substrate, the fourth antenna radiating element having a fourth feed pad disposed thereon; and a fourth ground conductor positioned adjacent to the fourth antenna radiating element, the fourth ground conductor comprising a fourth ground pad thereon, the fourth ground pad being adjacent to the fourth feed pad of the fourth antenna radiating element.

2. The antenna system of claim 1, wherein at least one of said first through fourth antenna radiating conductors comprises a first radiating portion configured for radiating at a high band resonance, and a second radiating portion configured for radiating at a low band resonance.

3. The antenna system of claim 1, wherein at least one of said first through fourth antenna radiating conductors comprises a monopole type antenna radiating element.

4. The antenna system of claim 3, wherein said monopole type antenna radiating element comprises:

a feed pad;

a first radiating portion extending from the feed pad to a distal end; and a second radiating portion extending from the feed pad, the second radiating portion comprising a meander line section disposed parallel with a longitudinal conductor, the meander line section being coupled to the longitudinal conductor by a first coupling conductor extending therebetween, and the longitudinal conductor being coupled to the feed pad by a second coupling conductor extending therebetween.

5. The antenna system of claim 1, wherein at least one of said antenna radiating elements is configured for at least two resonances including 2.4 GHz and 5 GHz bands.

6. The antenna system of claim 1, further comprising: one or more structural conductors disposed on said substrate for providing added rigidity.

7. The antenna system of claim 6, further comprising:

one or more structural solder pads each being configured to secure a portion of a coaxial cable to one of said ground conductors or said structural conductors.

8. The antenna system of claim 1, said substrate comprising a flexible substrate.

9. The antenna system of claim 1, said substrate having a length of 80 mm, a width of 20 mm, and a thickness of 0.1 mm.

* * * * *